United States Patent [19]

Bertoglio

[11] Patent Number: 4,712,360

[45] Date of Patent: Dec. 15, 1987

[54] MACHINE FOR FILLING BAGS WITH A LIQUID AND SEALING THEM

[75] Inventor: Guido Bertoglio, Viganello, Switzerland

[73] Assignee: Water Line S.A., Mezzovico, Switzerland

[21] Appl. No.: 903,850

[22] Filed: Sep. 3, 1986

Related U.S. Application Data

[63] Continuation of Ser. No. 772,644, Sep. 4, 1985, abandoned.

[30] Foreign Application Priority Data

Sep. 24, 1984 [CH] Switzerland ..... 4552/84

[51] Int. Cl.[4] ..... B65B 9/10; B65B 43/30

[52] U.S. Cl. ..... 53/567; 53/266 R; 53/386

[58] Field of Search ..... 53/266 R, 373, 386, 53/567, 568, 570

[56] References Cited

U.S. PATENT DOCUMENTS

| | | | |
|---|---|---|---|
| 2,387,812 | 10/1945 | Sonneborn et al. | 53/386 X |
| 2,520,242 | 8/1950 | Gran | 53/266 |
| 3,398,503 | 8/1968 | Bertoglio | 53/386 X |
| 3,543,466 | 12/1970 | Forsberg | 53/570 X |
| 3,607,574 | 9/1971 | Satake | 53/570 X |
| 3,657,055 | 4/1972 | Nichols | 53/373 X |
| 3,755,984 | 9/1973 | Vanderpool | 53/386 X |
| 3,939,624 | 2/1976 | Gidewall et al. | 53/386 X |
| 3,939,628 | 2/1976 | Schjeldahl | 53/373 X |

*Primary Examiner*—E. R. Kazenske
*Assistant Examiner*—Michael D. Folkerts
*Attorney, Agent, or Firm*—Young & Thompson

[57] ABSTRACT

The machine allows filling of internally sterile plastic bags with any liquid and sealing them. The machine comprises: liquid-proportioning apparatus (1), jaws (17, 18) suitable for pneumatically holding the upper lips of the bag to be able to open, fill, close it by heat-sealing (jaws 7, 8). The most important part of the machine consists of devices (10, 11, 12) able to control the jaws to open the bag with cosinusoidal law acceleration, slowly at first, preventing detachment of the upper lips of the bag during opening, and then rapidly operating so as not to delay the successive operations of: closing, sealing and discharging of the filled bag. These devices consist of a toggle-joint lever system. They make possible a notable daily production of filled and heat-sealed bags with a single proportioning and heat-sealing station, or with a limited number of stations.

2 Claims, 10 Drawing Figures

MACHINE FOR FILLING BAGS WITH A LIQUID AND SEALING THEM

This application is a continuation of application Ser. No. 772,644, filed Sept. 4, 1985 now abandoned.

This invention has as its object a machine for filling bags, preferably made of plastic, and sealing them, in particular by heat-sealing.

Said machine is able to be advantageously used for filling internally sterile plastic bags with drinking water or other nutritious beverages to be distributed in areas struck by catastrophes (earthquakes, floods, etc.) to avoid epidemics due to storing said liquids in contaminated containers.

Nutritious beverages refers to those obtained by dissolving powdered milk, fruit juices, etc., in drinking water suitable for feeding children.

Machines for filling bags with a liquid, in particular drinking water and nutritious beverages, and sealing them by heat-sealing, to be used for marketing said products are known. For this purpose, reference is made to Swiss patents filed in the name of "Centra Anstalt di Vaduz" No. 386,912—396, 747—398,4-26—416,067 and conceived by the inventor of this invention.

These known machines comprise a rotary table, around which are distributed numerous liquid-proportioning stations and an equal number of stations for heat-sealing of the filled bags.

All of this is aimed at increasing daily production of filled and sealed bags, given the enormous number of bags required daily by consumers.

The machine according to the present invention, on the contrary, exhibits only a single liquid-proportioning station, or a very limited number of liquid-proportioning stations and a single-sealing station, or a very limited number of heat-sealing stations, corresponding to that of the proportioning stations, yet obtaining the same production of filled and sealed bags.

It therefore is far simpler than known machines, less costly, less bulky and easy to operate even by unskilled persons.

Opening of the bag represents the greatest problem, since the lips held by the jaws by vacuum are mutually held on their interior by coherence. To be able to open the lips of the bag it is necessary to act, at the beginning, with minimal speed, to give time for air to enter between the lips of the bag. This initial speed should not exceed the value of 1 mm per second.

If the action of the jaws is performed with a common compressed air cylinder at a speed of 1 mm/sec, 24 seconds would be required for complete opening of the bag.

The machine according to the invention achieves said aim since it is characterized by devices able to control the heat-sealing jaws so as to open the empty bag, at first slowly, avoiding detachment of the upper lips of the bag itself from the jaws by vacuum during its opening, and then rapidly with a cosinusoidal acceleration movement, so that opening of the bag can take place altogether in 2 seconds, with obvious saving of time, and therefore with greater hourly production.

All of this is obtained by a toggle-joint lever system controlling the jaws for opening and heat-sealing of the lips of the bag.

The accompanying drawings show three preferred embodiments of said machine, which are neither limiting or binding embodiments: a completely automatic, a semiautomatic and a manually operated machine.

Figure 1:
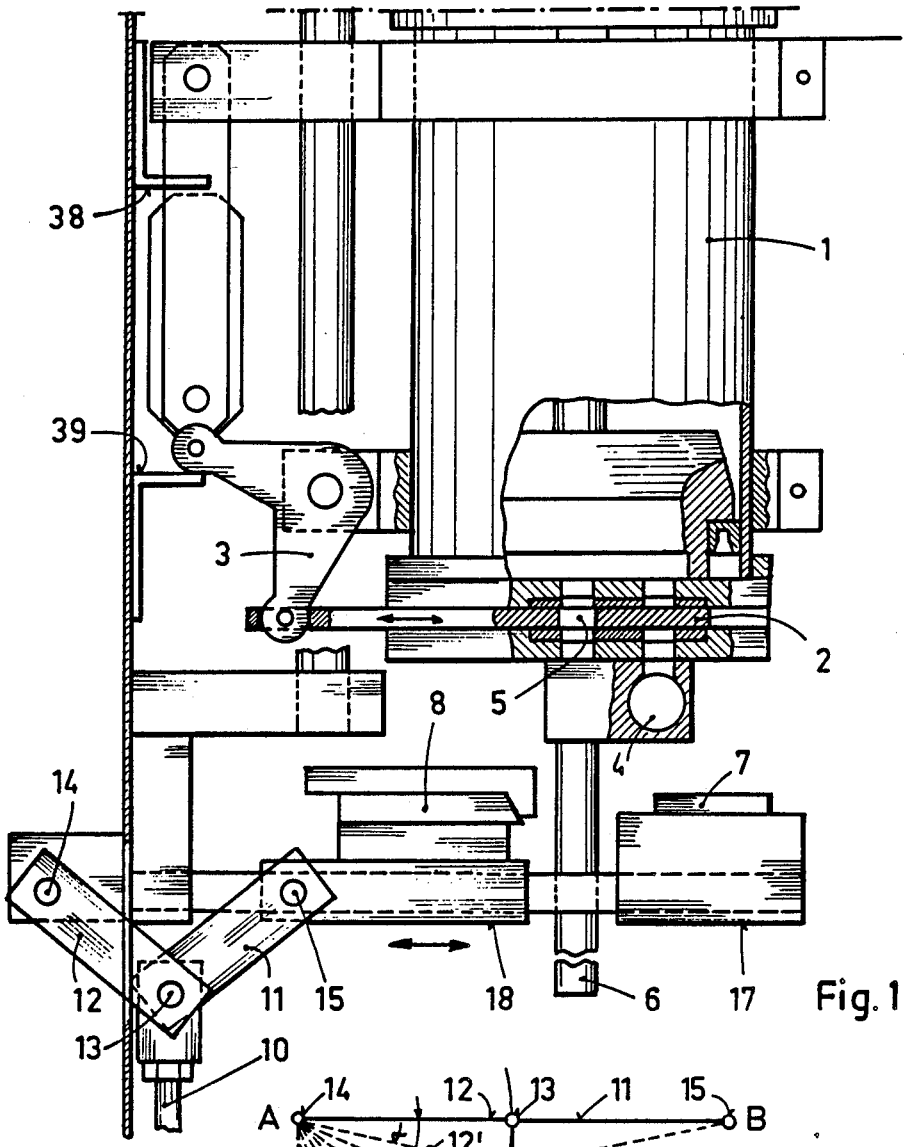
FIG. 1 represents, in partially sectioned side view, the proportioning and heat-sealing devices of said machine, common to all the embodiments shown.
Figures 3, 4, 5, 6:
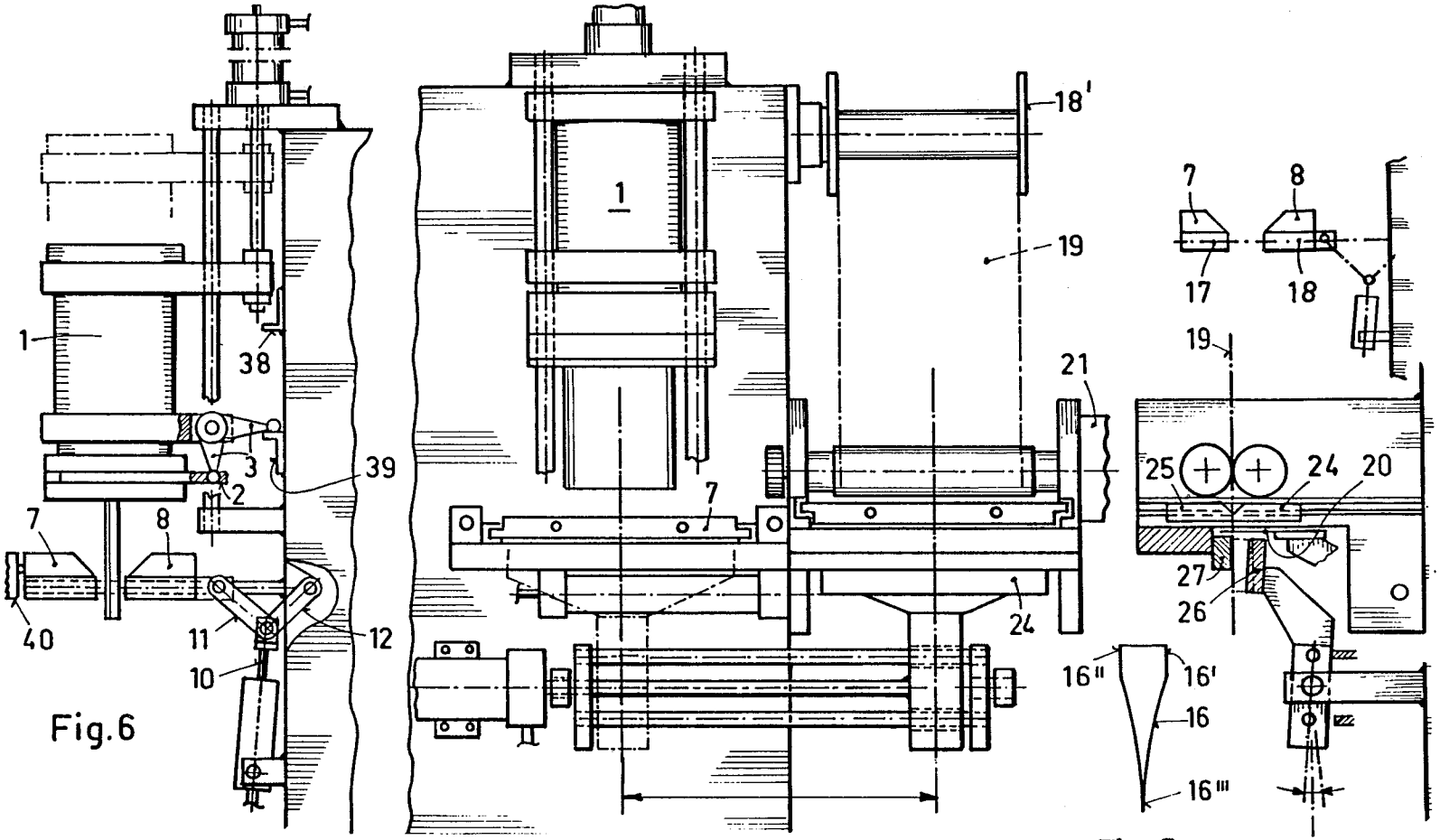
FIG. 3 is the front view of the first embodiment; the completely automatic machine.
FIG. 4 is a detail of FIG. 3.
FIG. 5 is a diagrammatic cross section of a bag heat-sealed at its base.
FIG. 6 is a side view of a second embodiment of said machine, which works semiautomatically.

With reference to FIGS. 1 and 3, the completely automatic machine comprises a cylinder 1 of liquid with which it is desired to fill the bags, particularly drinking water.

At the base of proportioning cylinder 1 is placed slide valve 2 operated by cranked lever 3.

The liquid, in particular water, arrives by pipe 4 and when slide valve 2 is moved all the way to the right, in the drawing, the water goes through opening 5 of the slide valve into proportioning cylinder 1 filling it to the preset level.

On the other hand, when slide valve 2 is moved to the left, the liquid descends through tube 6 and is discharged into the bag underneath, whose upper lips 16', 16" (FIG. 5) are held by jaws 17, 18. Jaw 18 is controlled by toggle-joint lever system 10, 11, 12.

Said toggle-joint lever system constitutes the most important part of this invention.

Figure 2:
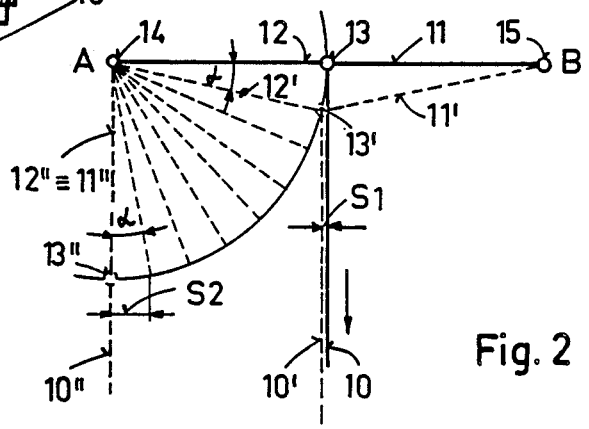
FIG. 2 is a diagram illustrating the behavior of the toggle-joint lever system controlling the heat-sealing jaws, a lever system common to all three embodiments shown.

It comprises (see also the diagram of FIG. 2), two levers 11 and 12 hinged at 13. Lever 12 is hinged on stationary pin 14, while lever 11 is connected, by pin 15, with mobile jaw 18. When the jaws are closed, the two levers 11 and 12 are on the same line A—B (FIG. 2). When connecting rod 10 is moved downward (either manually or mechanically), pin 15 and consequently jaw 18 will be moved according to a cosinusoidal law. As can be seen in FIG. 2, movement "$S_1$" of the jaws when pin 13 moves through angle $\alpha$ to position 13' is very small (opening of the bag), while movement "$S_2$" of the jaws when pin 13 moves through angle $\alpha$ close to position 13" is very large (final phase of the opening of the bag).

The initial slow opening prevents the detachment of lips 16' and 16" from jaws 17 and 18, providing sufficient time for the air to enter between the inside lips of the bag so that they remain attached by vacuum effect to the suction cups of jaws 17 and 18.

Above suction-cup jaws 17 and 18 are placed hot-wire heat-sealing jaws 7 and 8. Sealing jaw 8 is carried by mobile suction-cup jaw 18 while sealing jaw 7 is mobile with respect to suction-cup jaw 17, which is stationary. Sealing jaw 7 is operated by compressed air cylinder 40 (FIG. 6).

The subsequent rapid opening makes it possible, without useless waiting, to start the filling and heat-sealing cycle and consequently to increase hourly production of filled and heat-sealed bags.

With reference to FIGS. 3 and 4, the completely automatic machine comprises, at the side of proportioning cylinder 1, a reel 18 from which is unwound a continuous tubular strip from which the bags are taken.

The various operations that are successively performed are the following:

(1) Motor 21, provided with a brake, receives a current pulse from a timer (not shown) to cause the advance of tubular strip 19 for a length equal to that of the bag it is desired to make, a length that depends on the length of said current pulse. At the end of the advance of the bag, conveyor suction cup 26 is closed against stop 27. At the same time, a vacuum is created in jaw 26 that attracts lips 16' bag 16 of (FIG. 5).

(2) Heat-sealing jaw 24 is pushed against heat-sealing jaw 25 and sealing of bottom 16''' of the bag occurs.

(3) Then horizontal cutting of the lower bag is performed by blade 20.

(4) Jaw 26 holding lip 16' of the lower brake by vacuum effect is now detached from stop 27 and moved laterally placing itself under proportioning cylinder 1 placed to the left of the machine in FIG. 3.

(5) Still at the left of the machine, i.e., under proportioning cylinder 1, jaw 26 is pushed toward jaw 17, the vacuum in 26 is released, lip 16' of the bag remains free, while lip 16' continues to adhere to suction cup 27 of jaw 17. Jaw 26 returns under the rollers. The toggle-joint is operated by connecting rod 10 so as to push suction-cup jaw 18 against suction cup 17 where bag 16 is held by vacuum. When suction-cup jaw 18 is in contact with lip 16' the vacuum is operated so that lip 16' is held by mobile suction-cup jaw 18, while lip 16'' is held by stationary suction-cup jaw 17.

At this moment, by acting manually or mechanically on connecting rod 10, mobile suction-cup jaw 18 is opened with a cosinusoidal law acceleration, consequently opening bag 16.

(6) Cylinder 1 is lowered (FIG. 8) and the phase of filling the bag with the liquid contained in cylinder 1 is performed, the cylinder 1 rises.

Figures 7, 8, 9, 10:
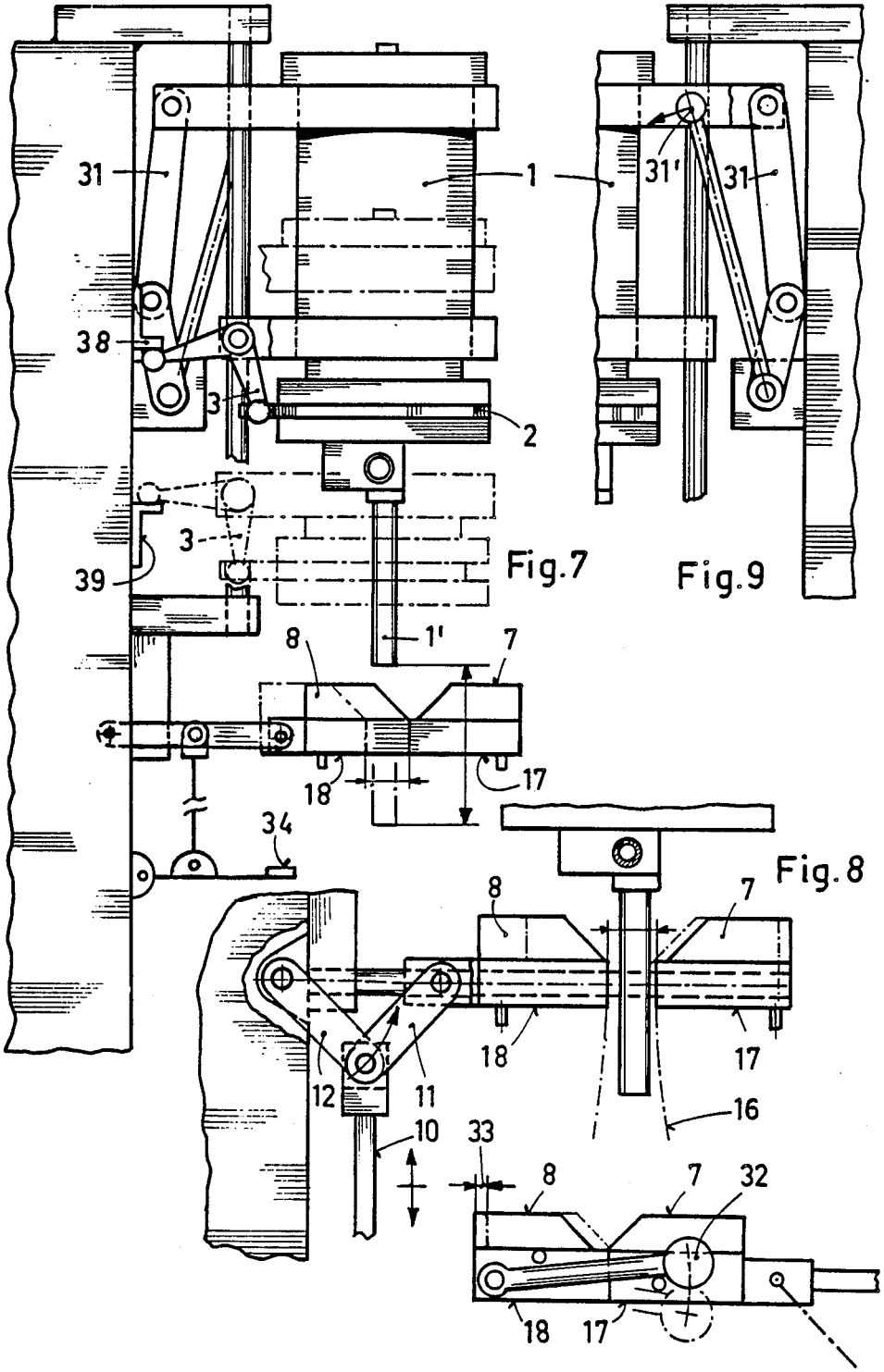
FIG. 7 is the side view of the third embodiment of said machine, working with manually operated controls.
FIGS. 8, 9, 10 are details of the machine according to FIG. 7.

(7) Heat-sealing of the bag is done by heat-sealing jaws 7 and 8 (FIG. 7).

(8) Suction-cup jaw 18 opens, the vacuum ceases and the full bag falls into a suitable container.

(9) While the bag is being filled, another bag is being prepared, so that as soon as jaw 17 opens and the full bag fails, suction cup 26 carries another empty bag under the cylinder, making to adhere to suction-cup 17, and the cycle is repeated.

FIG. 6 shows a variant of the machine, in the sense that it is semiautomatic, i.e., not having tubular strip 19 and devices that make it advance, heat-seal and cut it.

Bags, already preformed, then are applied by hand to suction-cup jaws 17 and 18.

Jaw 18 is moved always by the toggle-joint lever system shown in FIG. 1, obtaining slow opening and successive rapid operations as previously explained.

FIGS. 7, 8, 9 and 10 show a machine according to the invention that is even simpler, i.e., operated by hand.

Pressing on pedal 34 causes opening of the bag by toggle-joint lever system 10, 11, 12 with cosinusoidal law acceleration.

Also in this case the bag is introduced by hand between jaws 17 and 18.

Heat-sealing of lips 16', 16'' of the bag (FIG. 5) is performed by operating lever 32 (FIG. 10).

For greater clarity, the operations to be performed by hand are:

(1) Suction-cup jaw 18 is opened by pressing pedal 34.

(2) The bag rests on said suction-cup jaw 18.

(3) The pedal is released, suction-cup jaw 18 closes, the bag is held between two suction-cup jaws 17, 18.

(4) The cock that puts the vacuum in communication with two suction-cup jaws 17 and 18 is opened by hand so that the lips of the bag are aspirated by the jaws.

(5) Pedal 34 is pressed, jaw 18 reopens, and the bag is opened.

(6) Lever 31' is lowered, cylinder 1 is lowered by operating lever system 31, lever 3 by resting on stop 39 opens slide valve 2, and the liquid descends into bag 16.

(7) Lever 3 is lifted, consequently lifting cylinder 1. Lever 31 by resting on stop 38 closes the communication between cylinder 1 and tube 1' and opens the communication between the liquid intake and the cylinder, to fill it.

(8) Pedal 34 is released; suction-cup jaw 18 closes.

(9) By lever 32 being pushed, heat-sealing jaw 7 is pushed, and at the same time a switch (not shown) is operated which gives the current pulse for the heat-sealing.

(10) Pedal 34 is pressed, the jaws open, the bag falls and the cycle begins again.

The form of the various devices can, of course, vary in the sense that devices of known type can be replaced by equivalent known devices, without going outside the scope of protection of the invention.

I claim:

1. Machine for filling bags with a liquid and sealing them, comprising:

liquid proportioning means;

a pair of jaws adapted to open substantially along a given direction, said pair of jaws having suction means for holding the upper lips of a bag by partial vacuum, said pair of jaws being mounted beneath said liquid proportioning means;

a toggle joint comprising two pivotally interconnected links and an actuating member connected to said joint at said pivotal interconnection, each said link having an end remote from said pivotal interconnection and said actuating member being displaceable in a direction substantially perpendicular to said given direction; at least one of said remote ends being pivotally connected to one of said pair of jaws; said pair of jaws being closed when said links are extended relative to one another, and open when said links are more nearly collapsed relative to one another; whereby displacement of said actuating member in said perpendicular direction at a constant rate will open said closed jaws at a progressively increasing rate;

and a manually operable pedal for pulling said actuating member in a direction to open said jaws.

2. Machine according to claim 1, and a pair of heat sealing jaws disposed between said liquid proportioning means and said pair of jaws having suction means, said pair of heat-sealing jaws being closable independently of said pair of jaws having suction means.

* * * * *